US005489365A

United States Patent [19]

Wahlstrom

[11] Patent Number: 5,489,365

[45] Date of Patent: Feb. 6, 1996

[54] ADJUSTABLE TWIN-WIRE FORMER WITH SUCTION BOXES FOR SIMULTANEOUS DRAINAGE IN BOTH DIRECTIONS

[75] Inventor: Borje Wahlstrom, Rosemont, Pa.

[73] Assignee: Valmet Paper Machinery Inc., Helsinki, Finland

[21] Appl. No.: 237,781

[22] Filed: May 4, 1994

Related U.S. Application Data

[63] Continuation-in-part of Ser. No. 960,732, Oct. 14, 1992, abandoned.

[51] Int. Cl.[6] ..... D21F 1/00; D21F 1/52

[52] U.S. Cl. ..... 162/301; 162/203; 162/374

[58] Field of Search ..... 162/203, 300, 162/301, 352, 374

[56] References Cited

U.S. PATENT DOCUMENTS

| | | | |
|---|---|---|---|
| 3,595,744 | 7/1971 | Skoldvist | 162/301 |
| 4,769,111 | 9/1988 | Nevalainen et al. | 162/301 |
| 4,790,909 | 12/1988 | Harwood | 162/301 |
| 4,988,408 | 1/1991 | Evalahti | 162/301 |
| 5,045,153 | 9/1991 | Sollinger | 162/301 |
| 5,061,347 | 10/1991 | Bubik et al. | 162/301 |
| 5,074,964 | 12/1991 | Partanen | 162/300 |
| 5,167,770 | 12/1992 | Bubik et al. | 162/301 |
| 5,221,438 | 6/1993 | Takeuchi | 162/301 |

FOREIGN PATENT DOCUMENTS

| | | | |
|---|---|---|---|
| 3138133 | 3/1983 | Germany | 162/300 |
| 3406217 | 10/1985 | Germany | 162/301 |

*Primary Examiner*—Karen M. Hastings

*Attorney, Agent, or Firm*—Cohen, Pontani, Lieberman & Pavane

[57] ABSTRACT

An adjustable twin-wire gap former is provided for forming a fiber web from an aqueous fiber suspension. The twin-wire gap former is arranged so that the first and second coacting, traveling, looped forming wires have juxtaposed sections, which define a forming zone and confine a paper web therebetween during its formation. A first means for providing suction is located adjacent the first wire fabric in the forming zone for draining water from the suspension and a second means for providing suction is located adjacent the second wire fabric in the forming zone. This second means for providing suction is movable toward and away from the second wire thus adjusting the geometry of the forming zone. Preferably a central operator controls the vacuum in the suction boxes and the pressure exerted by the boxes onto the forming fabric independently of each other.

5 Claims, 6 Drawing Sheets

ADJUSTABLE TWIN-WIRE FORMER WITH SUCTION BOXES FOR SIMULTANEOUS DRAINAGE IN BOTH DIRECTIONS

RELATED APPLICATIONS

This application is a Continuation-in-part of U.S. patent application Ser. No. 07/960,732, filed Oct. 14, 1992, now abandoned.

FIELD OF THE INVENTION

Both the apparatus and method of this invention relate generally to paper web forming sections such as gap formers or hybrid formers and particularly to an adjustable twin-wire forming section having suction boxes on both sides of the web with the suction boxes being movably controlled so that the forming geometry of the twin-wire former is adjustable by, for example, an operator who controls the vacuum in the suction boxes and the pressure exerted by each of the boxes on the forming wires or fabrics independently of each other, thus making it possible to form a more uniform sheet despite variations in the basis weight and grade range of the paper stock. By controlling the pressure exerted on the forming wires, independently of the vacuum used for drainage, the forces between the wires, which control the sideways movement are minimized. This allows a longer drainage area further increasing the drainage capacity of the former.

BACKGROUND OF THE INVENTION

The present invention relates generally to an adjustable free jet twin-wire former for forming a fiber web. This adjustable twin-wire former has suction boxes on both sides of the twin-wires with at least one of the suction boxes or suction box covers being movable relative to the wires. By controlling the movement of at least one of the suction boxes or the box covers the geometry of the twin-wire may be adjusted based on the drainage characteristics of the liquid-fiber suspension, known as paper stock, in order to improve the overall drainage of the web. Most importantly, the pressure in the forming zone, that is, the pressure exerted on the liquid fiber suspension between the fabrics, is controlled by the pressure exerted by the moveable suction elements on the contacting fabric.

More specifically, the forming geometry of the twin-wire former is adjustable in response to an operator independently controlling the vacuum in the suction boxes and the pressure exerted by the boxes on the forming fabric. This ability to apply vacuum from both sides and to independently control the pressure exerted by the boxes on the forming fabric makes it possible to use much higher drainage forces and a longer forming zone and thus increase the drainage capacity. More importantly, this type of forming zone geometry allows an adjustable twin-wire former to run heavier basis weights, at lower consistencies, and at higher speeds while improving the quality and uniformity of the sheet.

During the last three decades, twin-wire formers have been developed in which the aqueous-fiber suspension is injected between two fabrics or wires in a thin stream or jet. This allows simultaneous drainage of the water through both fabrics and eliminates the limitations caused by free surface flow which limits the speed of a single wire former. Today, these twin-wire formers, often termed free jet gap formers, run the fabrics under tension over a curved surface, made up of either rolls, curved shoes or boxes. Any or all of these curved surface elements can be either drilled or have ribbed surfaces as well as vacuum for additional drainage.

The inside wire of a free jet gap former is traditionally supported by either a rotating or stationary element. The drainage in the inner direction through the inside wire is determined by the pressure exerted on the stock by the outside wire and by the vacuum exerted on the inside wire. If the stationary or rotating element is ribbed or is provided with individual strips in the suction boxes, the drainage pulses due to the pressure variations caused by the ribs or strips which effect a change in cross-sectional area over the ribbed sections of the stationary elements. This pressure change causes shear, which improves the formation of the web and reduces retention and thus affects the fines and filler distribution, as well as affects the wire mark and surface characteristics. By increasing the vacuum level and altering the type of support structure, the properties of the inside wire side of the formed sheet can be varied.

The outside wire exerts a pressure (P) against the stock that is equal to the wire tension (T) divided by the radius of the surface over which it passes (R), eg.

$$P = \frac{T}{R}$$

This pressure, exerted by the outside wire, in addition to providing a driving force for drainage, provides stability for the fabric. By both running in an arc and exerting a pressure, the outside wire adjusts its position based on the drainage characteristics of the stock and the drainage along the path. However, because there are no ribs engaging the outside wire, the drainage is under constant pressure and accordingly there is no pulsing on the side of the sheet facing the outside wire. Thus, the two sides of this sheet are formed under different conditions and are not identical, thereby leading to undesirable asymmetrically formed sheets.

In order to provide pulsing on the outside free floating wire, some prior art formers utilize doctors. These stationary elements, blades or strips scrape off the water that drains in this direction providing the necessary shear which improves the formation of the sheet. As mentioned above, this effects the fines and filler distribution, as well as the wire mark and surface characteristics. These line contact devices or doctors are normally used on the outside wire and do not materially affect the position or geometry of the outside wire. The outward drainage force is therefore provided by the pressure exerted by the wire. This pressure for commercially used formers today varies between 0.1 to 1.0 meter water gauge. The drainage in the outward direction is therefore limited and not controllable.

As mentioned above, prior art twin-wire formers with all the stationary elements on one side, will give an asymmetrical sheet. In order to reduce or eliminate this asymmetrical formation, it has previously been suggested that the curvature of the twin-wire former may be changed so that stationary elements can also be put on the outer side as well as on the inside. Such prior art twin-wire formers which are provided with stationary elements on both sides with the elements on one side being moveable (e.g. Duoformer D, Symformer MB) have vacuum applied only to one side and are limited as to drainage capacity as well as require an increased forming zone length.

Another limitation of these prior art twin-wire formers is the fact that the forming pressure for drainage through the outer wire is equal to the pressure between the wires. The pressure between the wires caused by the tension of the outer wire and its radius, in addition to being the driving force for drainage, is the driving force for a lateral sideways movement of the fiber suspension out towards the edges. The distance laterally that the fiber suspension will travel is approximately proportional to the time, t, between the wires times the square root of the pressure, $\Delta p$. When this driving force, the pressure between the wires caused by the tension of the outer wire and its radius, $t\sqrt{\Delta p}$ exceeds a certain value, the fiber suspension trapped between the fabrics will get pushed out through the sides of the forming zone. This limits the drainage time and thus the forming length that can be used on gap formers.

As the pressure between the wires is the force for drainage in one direction, (the outer direction) and the vacuum on the other side plus this pressure minus centrifugal force is the drainage force in the other direction (the inner direction), it is possible to effect the sideways movement and its relationship to drainage capacity by increasing the vacuum in a stationary element such as a vacuum box or in a vacuum roll. The importance of the sideways movement can be illustrated easily. When running a twin-wire former, one can show that if the machine is started and run at a certain speed and with water and no fiber, there is hardly any sideways movement and the drainage length is very short. As fibers are added to the water so that the consistency (percentage of fiber) of the stock increases, the drainage length increases, as does the sideways or lateral movement of the stock. At a given point, the aqueous-fiber suspension starts to squirt out from between the wires, sideways. This is the limit of consistency for that particular twin-wire former. Accordingly, the limiting factor for a twin-wire former is basically drainage time, which in turn is dependent on basis weight, drainage resistance, headbox consistency, drainage pressure, temperature and pulsing, depending on what parameters are available for adjustment.

In order to improve the understanding of drainage capacity and the need to increase the drainage capacity of gap formers, a review of the physics of drainage should be considered. The time it takes to drain a fiber suspension under constant pressure without disturbance can be expressed as $t=G\times\mu\times C^{-1}\times W^{\alpha}\Delta p^{\beta}$. Here:

t= drainage time in seconds.

G= drainage resistance constant, characteristic of each furnish.

$\mu$=viscosity of water, which drops dramatically with temperature. (The higher the temperature, the lower the viscosity.)

C= consistency of fiber suspension.

W= basis weight in $g/m^2$ of the paper being formed.

$\Delta p$= pressure drop available for drainage in meters of water (mwg).

$\alpha$= exponent that normally is around 2 for relatively free sheets, but can go up to 3½ for highly beaten stock.

$\beta$=−½ in most cases.

This equation shows that the drainage curve is basically parabolic against basis weight. That is, drainage time increases at least as the square of the basis weight (assuming $\alpha$=2) and is inversely proportional to the headbox consistency and to the square root of the pressure drop, and directly proportional to the viscosity.

The drainage time can be replaced by the active drainage length, L, divided by the speed of the wire, V. The equation can then easily be transformed to a drainage capacity equation by transferring the square root of $\sqrt{\Delta p}$ and V to opposite sides. This gives the equation the form of $L\times\sqrt{\Delta p}=DC=G\times\mu\times C^{-1}W^{2}\times V$. Realizing that the $L\times\sqrt{\Delta p}$ is the sum of all the drainage elements in the forming table, one can replace $L\times\sqrt{\Delta p}$ with the sum of $f\times L\times\sqrt{\Delta p}$ for each drainage element. This expression corresponds to the drainage capacity of the former if the maximum $\Delta p$ is used. The factor f is a constant which is included to take care of the effect of disturbances or pulsing on the drainage resistance of the web.

By pulsing the liquid-fiber suspension, as discussed earlier, some fines are washed out and the liquid-fiber suspension expands thus reducing the drainage resistance. Based on plots of this drainage capacity, as the drainage capacity of each element is additive, it can be shown that the factor f for table rolls is close to 2, for foils about 1.5 and is somewhat less for other stationary elements. Based on this equation, the drainage capacity of a given forming zone can be determined, element by element, by adding the active drainage capacity of each individual element together. This works very well for single wire formers. It can also be applied to twin-wire formers by applying the formula: total drainage capacity, $DC_T,=D_1+D_2+2\times\sqrt{D_1\times D_2}$.

$D_1$ and $D_2$ are the drainage capacities of the inner and outer wire respectively, based on the active drainage elements in each fabric. Using these formulas, the drainage capacity of any single wire or twin-wire former can be calculated with some degree of accuracy. It illustrates that any former has a defined drainage capacity which determines the capability of this former.

Based on the time it takes to drain a fiber suspension under constant pressure, discussed previously, it is obvious that the time to form a web of half weight is only ¼ of that needed to form a like sized web of full weight. A gap former will then only need one quarter of the drainage time and therefore one quarter of the drainage length (using the same drainage elements) than a single wire forming section producing a web of the same basis weight. This is shown by the drainage capacity equation where, if $D_1+D_2$ are equal, the drainage capacity for a gap former with a $D_1$ drainage capacity on each side is equal to $4D_1$. This illustrates why twin-wire forming is such a powerful tool.

The drainage capacity equation can be further changed by including the fact that production per unit width, P, is equal to the product of the basis weight, W, and the speed, v. The drainage capacity, DC, is thus equal to $G\times\mu\times P(\text{production})\times W\times C^{-1}$. A machine with a given drainage capacity and a fixed production will have to have the headbox consistency raised in proportion to the basis weight to be formed. For a given basis weight and consistency, the required drainage capacity increases in direct proportion to the production rate. However, for the presently available gap formers, the drainage capacity is limited by the sideways flow caused by the product, $t\times\sqrt{\Delta p_f}$. This limitation of the drainage capacity of gap formers limits the types of papers that can be made on gap formers.

In the equation $t\times\sqrt{\Delta p_f}$, which controls the sideways flow, t is equal to the drainage time needed to form the sheet, while $\Delta pf_f$ is the pressure exerted in the area between the fabrics. By keeping $\Delta p_f$ small, the drainage time, t can be dramatically increased. Also by keeping the $\Delta p_f$ low compared to the $\Delta p_d$'s used for drainage through the fabrics, it is possible to greatly increase the drainage capacity of twin wire formers with both $\Delta p_f$ and the outward $\Delta p_d$ on roll formers being in the order of 1 m w.g. Here, $\Delta p_f$ and $\Delta p_d$ are basically the same if the centrifugal force is ignored. However, using curved, stationary elements, the $\Delta p_f$ and outward $\Delta p_d$ are normally in the order of 0.1 m w.g. By using vacuum for controlling drainage in both directions in the order of 0.3 to 3 m w.g., one can increase the drainage capacity on the outside wire by a factor of 1.7 to 10. This allows the formation of sheets with basis weights of up to three times the basis weights that can be formed on conventional twin wire formers.

Further reasons for this limitation of the drainage capacity include the relationship between formation and forming consistency, formation and pulsing, and the relationship between formation and paper properties. Formation, expressed as the standard deviation of the mass of the paper over a very small area, decreases linearly with the inverse of headbox consistency to below 0.1% effective consistency for long fibered pulps with an average fiber length of ~3 mm. For hardwood pulps with fiber length of ~1 mm, formation improves linearly with the inverse of the headbox consistency to 0.4 to 0.5%. The formation is considerably better for short fibered stocks than long fibered stocks at the same consistency. For most papers, the effective long fiber consistency determines the formation. There is also a linear relationship between formation and tensile strength as well as many other paper properties such as the printing surface which also improves with formation. At a given consistency, pulsing during the forming process will improve the formation.

Even if the level of formation improves with pulsing, there is still a straight line relationship between formation and effective headbox consistency for each forming section. For a given paper quality, the market determines what is an acceptable formation, which in turn, for a given paper machine and furnish, determines the maximum headbox consistency that can be used to make a satisfactory product. Because of the drainage capacity limitations of gap formers, this has limited the use of gap formers to certain paper grades. Grades that can be successfully made on today's gap formers are tissue, newsprint, light weight coated paper (LWC), SC grades, lighter weight, groundwood specialties, lightweight fine papers and, in special cases, corrugating medium and lightweight liner board. However, the fine papers made on today's gap formers from a substantial amount of long fibers do not have optimum formation, nor do the linerboard sheets. With today's increasing machine speeds and the need for increased paper quality, it is becoming more and more important to develop gap formers with much higher drainage capacity. This is even more important for multi-ply structures. Accordingly, as the drainage capacity needed to form a sheet under a given set of conditions is inversely proportional to the headbox consistency, this means that higher drainage capacity is needed in order to lower the forming consistency and thus improve formation and sheet properties.

As an example, multi-ply fine papers should preferably be made with hardwood fibers on the outside and long softwood fibers on the inside in the center. This gives a sheet with good mechanical properties, such as stiffness, and optimal surface properties for good printing. However, to be able to form a satisfactory multi-layer structure from a furnish with 50% softwood or more, it is necessary to use a twin-wire former with about two to three times the drainage capacity available today. The object of this invention is to make it possible to build twin-wire formers that can accomplish this goal.

According to this invention, this is achieved by controlling the pressure between the wires independently of the forces needed for drainage. This way one can increase the drainage time and the drainage forces without being limited to the same extent by lateral flow as in present day twin-wire forming sections.

The purpose of this invention is to remove the drainage limitations of presently used or available twin wire formers. These twin wire formers have a limited drainage capacity and, therefore, can only be used to make low weight papers and boards. Twin wire formers today, therefore, are used basically for grades like newsprint, LWC, SC papers, mechanical specialties, lighter weight fine papers, corrugating medium and lightweight linerboard. Twin wire formers cannot be used for heavy weight sheets or papers from slow draining stocks. In addition, because of the drainage capacity limitations and in many cases, the papers and boards cannot be formed at consistencies that will give optimum formation. This limited drainage capacity is also the reason that multi-ply papers for grades such as fine papers, linerboard and other board grades have alluded manufacture. Limited drainage capacity also limits the speed at which the different grades can be manufactured. This invention, then, not only improves the quality of the papers and boards and increases the weights where twin wire formers can be used, but also increases the speed at which they can be manufactured.

Because the former uses identical elements and forces on both sides of the sheet, a symmetrical sheet can be produced. This invention also provides action from stationary elements on both sides, which has a very beneficial effect on formation. By using stationary elements and vacuum, control of drainage and fines and filler distribution can easily be achieved. By independently controlling the pressure exerted by the fabrics on the fiber suspension in the wedge and the vacuum exerted by the suction boxes for drainage, it is possible to dramatically increase the drainage capacity, shortening or lengthens the former when advantageous or when it is needed for maximum drainage capacity. This increased drainage capacity, together with the activity on both sides, leads to the ability to make an improved formed sheet with a symmetrical structure.

THE PRIOR ART

As discussed previously, twin-wire formers for forming a fiber web are known and have been described. Unfortunately, prior art attempts have suffered from various drawbacks as already discussed. Other drawbacks and limitations of prior art gap formers are discussed below.

There are numerous articles of prior art, both patented and unpatented. All of these show twin-wire formers with an aqueous fiber suspension (paper stock) therebetween. Some prior art formers move the twin-wire along a substantially horizontal path and some along a substantially vertical path. Some use suction boxes to enhance dewatering, some use blades, doctors or slices, some use suction boxes and some use centrifugal dewatering. Typical and exemplary of such prior art are U.S. Pat. No. 2,881,676 to Thomas, U.S. Pat. No. 3,440,136 to Nelson et al, U.S. Pat. No. 3,810,818 to Arledter, U.S. Pat. No. 3,743,571 to Ward, U.S. Pat. No. 3,823,062 to Ward et al, and U.S. Pat. No. 3,823,064 to Ward.

None of the above recited prior art teaches or suggests an adjustable twin-wire former having suction boxes on both sides of the web with at least one of the suction boxes or box covers being movably controlled so that the forming geometry of the twin-wire forming zone is adjustable. No prior art reference discloses a pressure in the forming zone which is controlled by the pressure exerted by one or more moveable suction boxes on the contacting wires in which the boxes can be moved sufficiently to alter the geometry without changing the pressure in the forming zone. Additionally, the prior art references do not disclose a gap former in which an operator controls the vacuum in the suction boxes and the pressure exerted by the boxes on the forming fabric independently of each other.

DETAILED DESCRIPTION OF THE DRAWINGS

For a fuller understanding of the invention, reference is had to the following description taken in connection with the accompanying drawings in which.

DETAILED DESCRIPTION OF THE PRESENTLY PREFERRED EMBODIMENTS

Figure 1:
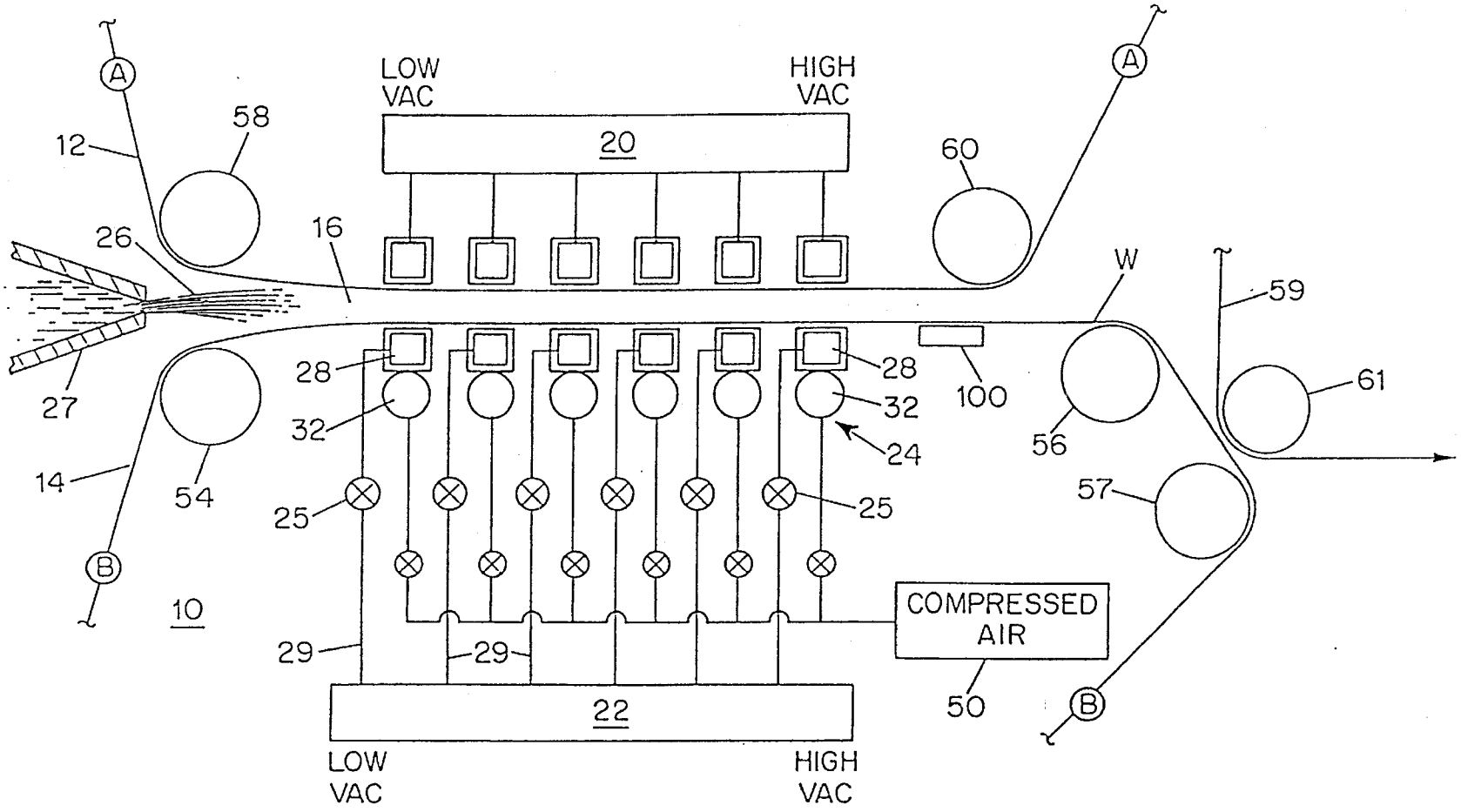
FIG. 1 is a schematic view, partly in elevation, partly in cross-section of a horizontal twin-wire former having upper and lower adjustable positionable suction boxes for adjusting the geometry of the forming zone in accordance with the present invention.

Referring now specifically to FIG. 1 of the drawings, an adjustable twin-wire former 10 includes a first wire or fabric 12 and a second wire or fabric 14. The first or upper wire 12 travels through a path around a breast roll 58 and then through a forming zone 16 in a substantially straight, substantially horizontal leg and then around a guide roll 60 and back to roll 58 along a path determined by convenience which is not shown and which forms no point of the invention per se. The second or lower wire 14 approaches the forming zone 16 by passing around breast roll 54 and then into the forming zone 16 where it travels in spaced apart but confronting relation with first wire 12. After leaving the forming zone 16, the lower or second wire, along with web W formed between wires 12 and 14 in the forming zone, passes over a transfer box 100, around a couch roll 56 and then downwardly at an angle toward a roll 57. Between rolls 56 and 57, the web W is picked off wire 14 by a felt 59 at the suction roll 61 to transfer web W to a press section (not shown). After wire 14 passes around roll 57 it continues along a path (not shown) back to breast roll 54. The first wire or fabric 12 and the second wire or fabric 14 coact in the forming zone 16 where the wires travel together in closely spaced relation and confine paper stock between them for dewatering to form the fiber or paper web W therebetween as will be described hereinafter.

Figure 2:
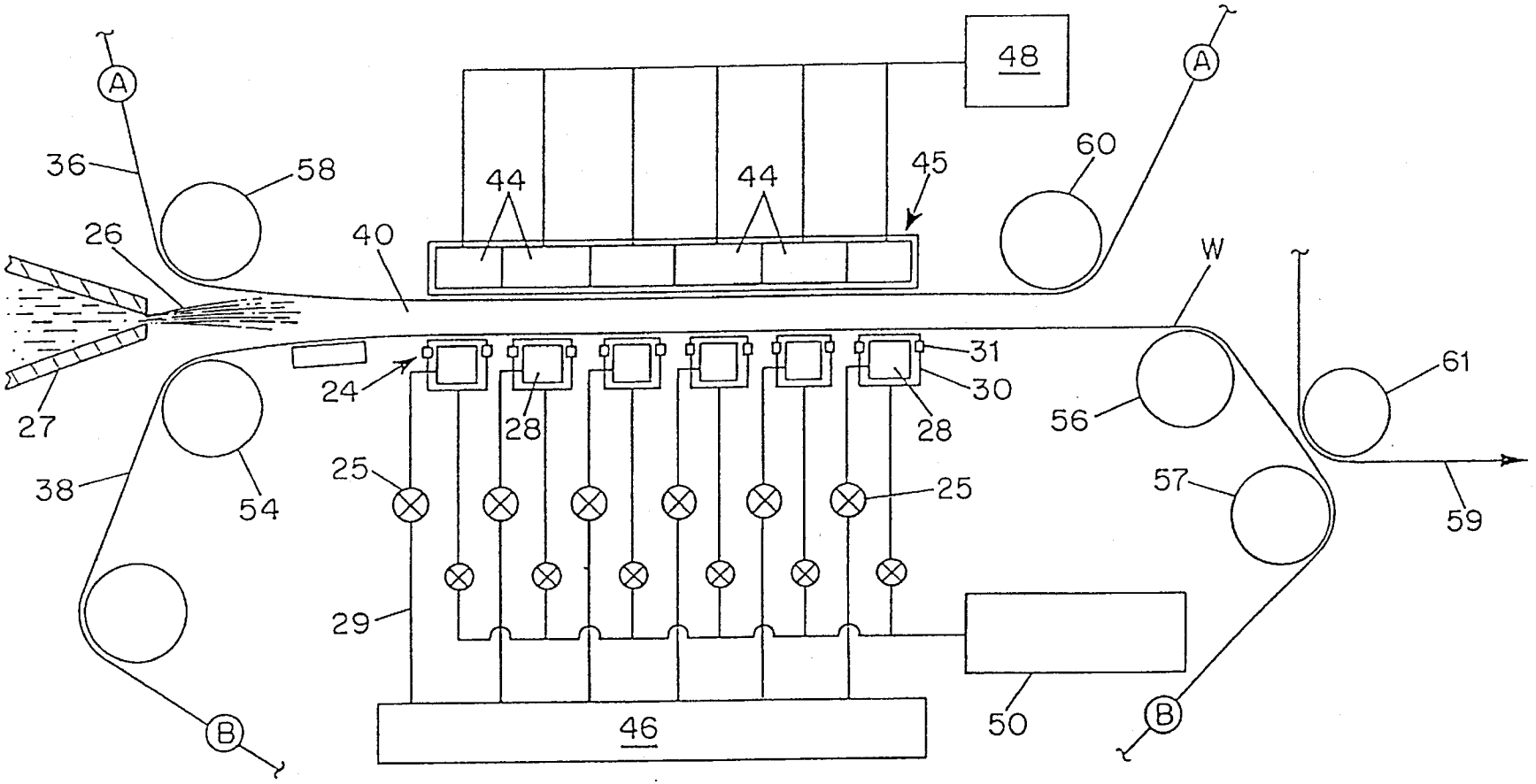
FIG. 2 is a view similar to FIG. 1 illustrating movable suction box covers.

The first wire or fabric 12 coacts with a first means for applying suction 20 located above and adjacent the first wire 12 for draining water from the paper web W in formation in an upward direction. The second wire or fabric 14 coacts with a second means for providing suction 22 for draining the web W in formation in a downward direction. The second means for providing suction 22 includes one or more suction boxes 28 here shown as 6 in number. Such boxes 28 are adjacent and below the second wire 14 and are independently moveable of one another relative to the second wire or fabric 14, whereby to alter the path of wire 14 in the forming zone 16. To effect movement of each of said suction boxes 28, means for movably positioning the suction boxes 28, namely means 24, one for each suction box, interacts with the associated moveable suction box 28 so as to move said second wire toward or away from said first wire to adjust the pressure being exerted by said second wire 14 against the coacting juxtaposed first wire 12. Additionally, the suction boxes can be provided with movable covers 30 as shown in FIG. 2.

An exemplary moving means 24 for adjustably positioning suction boxes 28, to thereby vary the path and location of the wire 14 in the forming zone 16, includes pressure responsive device 32, such as bellows, expandable bladders, pistons and cylinders, mechanical springs or the like, connected to the associated moveable suction boxes 28 to move the suction boxes. Of course, the adjustable moving means 24 need not necessarily be pneumatic and the invention would operate satisfactorily if the system were hydraulic, electric, electro-magnetic or mechanically spring activated. However, as presently advised, pneumatic moving means 24 are preferred. An operator may be used to control the vacuum in the suction means 20, 22 and the pressure exerted by the adjustable moving means 24 on the suction boxes 28, and therefore the pressure in the forming zone 16, independently of each other. As the ideal drainage curve or shape of the forming zone is determined by the operating variables of the forming section such as speed, temperature, furnish, consistency and basis weight, the ability to apply vacuum from both wires 12, 14 makes it possible to use much higher drainage forces and a much longer forming area and thus increase the drainage capacity. The gap former 10 can now be used to run heavier basis weights, at lower consistencies and at higher speeds making it possible to widen the basis weight and the grade range of the furnish 26 used in gap formers as well as greatly improve the quality of the web W.

In order to produce a paper web W, a stream of stock 26 is provided from head box 27 and injected between the two wires 12, 14. As the stock 26 is carried through the forming zone 16, pressure is exerted by the upper and lower wires 12, 14 on the stock 26. This pressure is determined by the paths of the wires 12, 14 which are determined by the positions of the moveable suction boxes 28. Therefore, the movement of the suction boxes 28 directly correlates to the pressure in the forming zone 16.

Additionally, as the stock 26 is carried through the forming zone 16, it is dewatered by suction means 20 which drains the web in an upward direction. Suction boxes 28, which are adjacent and below the second wire or fabric 14 and are here shown to be independently moveable relative to the second wire of fabric 14 and provide further dewatering of the stock downwardly. As such, this ability to provide vacuum assisted drainage in both directions and to vary the shape of the forming zone 16 makes it possible to greatly improve the quality and uniformity of the sheet. After leaving the forming zone 16, the lower or second wire 14, along with web W formed in the forming zone 16, passes around a couch roll 56 and then downwardly at an angle toward a roll 57. Between rolls 56 and 57, the web W is picked off wire 14 by a felt 59 at the suction roll 61 to transfer web W to a press section (not shown).

In accordance with the present invention suction is applied to the lower or underside of wire 14 by one or more suction boxes 28, here shown as six in number, which are connected to a suction source 22 through piping or hosing 29. The degree of suction, or negative pressure applied to each suction box 28 is preferably controlled by a valve 25 in the piping or hosing connecting the suction box 28 to the suction source 22. Preferably the valves 25 are remotely controllable from a central location so that one operator can simultaneously control the suction on the several suction boxes as well as the overall negative pressure in suction source 22. As will become apparent hereinafter, one or more of the suction boxes are movable relative to wire 14 and preferably, this movement is controlled from the same central locations by the same operator. Additionally, the suction boxes 28 can be reversed so that the floating boxes 30 for controlling pressure in the forming zone 40 can be on top with the suction boxes 28 on the bottom.

Referring now to FIG. 2 of the drawings, an embodiment of the adjustable twin-wire gap former 34 includes a first wire or fabric and a second wire or fabric with the lower wire 38 being adjustably positionable in the forming zone 40. The first or upper wire 36 travels through a path around a breast roll 58 and then through the forming zone 40 in a substantially straight, substantially horizontal leg and then around a guide roll 60 and back to roll 58 along a path which is not shown and which forms no part of the invention per se. The second or lower wire or fabric 38 approaches the forming zone 40 by passing around the breast roll 54 and then into the forming zone 40 where it travels in spaced apart but confronting relation with the first wire 36. After leaving the forming zone 40, the lower or second wire 38, along with a web W formed in the forming zone 40, passes around a roll 56 and then downwardly at an angle toward a roll 57. The web W is picked off wire 38 by a felt 59 at the section roll 61 to transfer web W to a press section (not shown). After wire 38 passes around roll 57, it continues along a path (not shown) back to couch roll 54. Accordingly, the first wire or fabric 36 and the second wire or fabric 38 are coacting in the forming zone 40 where the wires travel together and confine the paper stock between them for dewatering to form a fiber or paper web W therebetween, as will be discussed hereinafter.

The first wire or fabric 36 coacts with a first means for providing suction 44 located above and adjacent the first wire 36 for draining water from the paper web W in formation in an upward direction. The means for providing suction or vacuum 44 includes a compartmentalized fixed suction box 45 located above and adjacent to the first wire fabric 36. Suction box 44 is positionable by means of screws or pistons (not shown) for placing it in a correct position to accommodate the opening between the wires where the stock or furnish 26 enters.

The second wire or fabric 38 also cooperates with a means for providing suction 46 located adjacent the second wire or fabric 38 for draining the web W in formation in a downward direction. The means for providing suction 46, comprises suction boxes 28, and suction box covers 30 here six in number.

Figure 7:
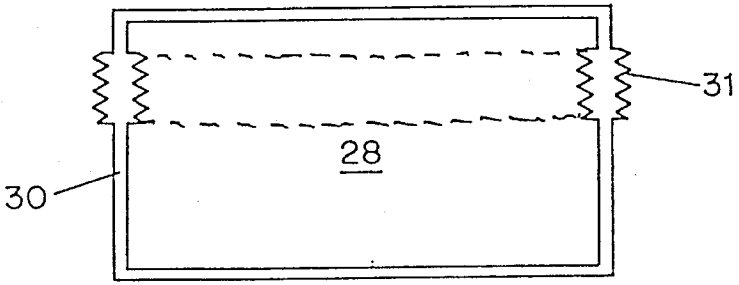
FIG. 7 is a cross-sectional schematic view of a suction box illustrating a movable suction box cover.

Referring to FIG. 7 and to the suction box cover 30 of FIG. 2, the suction box cover is movable relative to the fixed suction box 28 thereby altering the path of wire 38 in the forming zone 40. To effect movement of each of said suction box covers 30, (FIG. 2) an adjustable positioning device 24 such as a bellows 31, one for each suction box cover, interacts with the associated movable suction box cover 30, so as to move the second wire 38 toward and away from the first wire 36 to adjust the geometry of the forming zone and thus adjust the pressure being exerted by said second wire 38 against the first wire 36. The bellows 31, shown in FIG. 7, sealingly engages and is connected directly to both the suction box cover 30 to the fixed suction box 28 and thus provides a seal between the suction box 28 and the suction box cover 30 so that the loss of suction is minimized when the bellows is pressurized, thus moving the suction box cover 30 relative to the path of wire 38. As such, the bellows 31, provides both a seal along the entire edge of the fixed suction box 28 and the movable suction box cover 30 as well as a means for adjusting the suction box cover 30 relative to the wire 38. Although a bellows 31 is shown, any means for sealing and for providing adjustment of the suction box cover may be used.

As discussed above, in this FIG. 2 embodiment, suction box covers 30 are moveable relative to the fixed suction boxes 28. The first means for providing vacuum, negative pressure or suction 48 interacts with the suction box 45, while the second means for providing vacuum, negative pressure or suction 46 interacts with the independently moveable second suction covers 30, so as to exert pressure onto the coacting juxtapose twin-wire sections 40 so as to increase the drainage capacity of the gap former 34. If desired, moveable covers can also be provided for the first suction boxes 45.

In order to produce a paper web W utilizing the embodiment as described in FIG. 2, a stream of stock 26 is provided by head box 27 and injected between the two wires 36, 38 as they approach forming zone 40. As the stock 26 is passed through the forming zone 40, pressure is exerted by the tipper and lower wires 36, 38 on it. This pressure is determined by the paths of the wires 36, 38 which are determined by the positions of the moveable suction box covers 30 of the lower wire 28. Therefore, the movement of the suction box covers 30 directly correlates to the pressure in the forming zone 40.

Additionally, as the stock 26 is carried through the forming zone 40, it is dewatered by suction means 44 which drains the web in formation in an upward direction. Lower suction box 28, here shown to be fixed are adjacent and below the second wire or fabric 38 with the suction box covers 30 being independently moveable relative to the suction boxes 28 and provides further drainage of the stock downwardly. As such, this ability to provide drainage in both directions and to vary the geometry of the forming zone makes it possible to greatly improve the quality and uniformity of the sheet.

Figure 3:
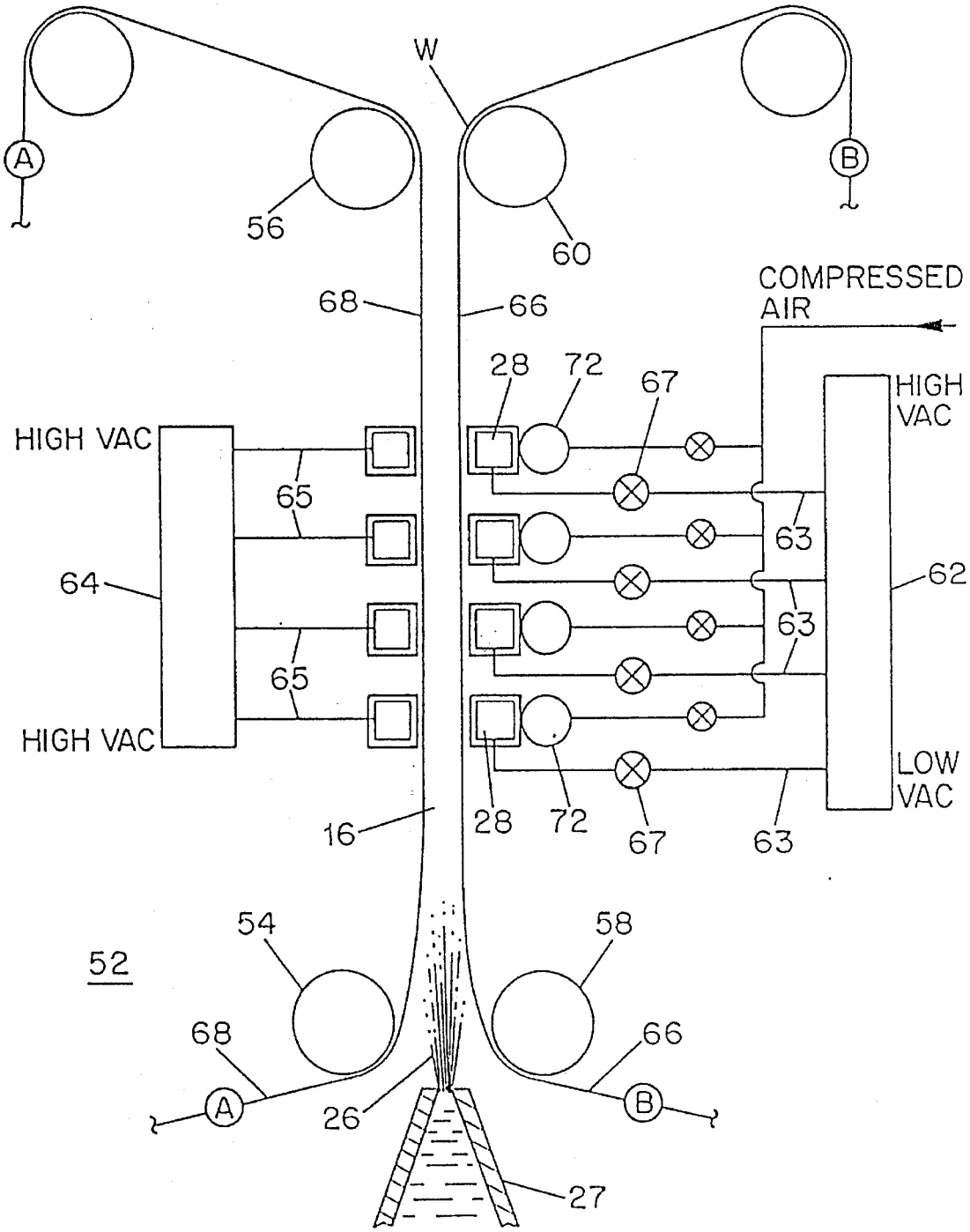
FIG. 3 is a schematic view, partly in elevation and partly in cross-section of a twin-wire former having a vertical forming zone and incorporating the present invention.

Referring now specifically to FIG. 3, a vertical adjustable twin-wire former 52 is shown, which includes a first wire or fabric 66 and a second wire or fabric 68. The first or right wire 66 travels through a path around a breast roll 58 and then through a forming zone 16 in a substantially straight substantially vertical leg and then around a guide roll 60 and back to roll 58 along a path determined by convenience which is not shown and which forms no part of the invention per se. The second or left wire 68 approaches the forming zone 16 by passing around breast roll 54 and then into the forming zone 16 where it travels in spaced apart but close confronting relation with first wire 66. The first wire fabric 66 and the second wire fabric 68 coact in the forming zone 16, where the wires travel together in closely spaced relation and confine paper stock between them for dewatering the stock to form a fiber or paper web W therebetween, as will be described hereinafter.

The first wire or fabric 66 coacts with a first means for applying suction 62 located adjacent the first wire 66 for draining water from the paper web W in formation in a rightward direction. The second wire or fabric 68 coacts with a second means for providing suction 64 for draining the web W in formation in a leftward direction. The dewatering suction from suction means 62 and 64 is applied to the outer surfaces of the respective wires 66 and 68 by suction boxes 28 adjacent the wire or fabric 66 and suction box 64 adjacent wire 68. The suction boxes 28 are connected to suction means 62 and 64 by pipes or hoses 63 and 65 through control valves 67. The suction boxes 28 adjacent wire 66 are independently moveable of one another relative to the first wire or fabric 66, whereby to alter the path of wire 66 in the forming zone 16. To effect movement of each of the suction boxes 28, moving means 72 for adjustably positioning suction boxes 28, one for each suction box 28, interacts with the associated moveable suction box 28 so as to move the first wire 66 toward and away from said second wire 68 to adjust the pressure being exerted by the first wire 66 against the coacting juxtaposed second wire 68 in order to control the pressure between the wires in the forming zone. An exemplary and presently preferred means 72 for adjustably positioning suction box 28, and thereby to vary the path and location of the wire 66 in the forming zone 16, includes pressure responsive devices as described above with regard to FIG. 1.

In order to produce a paper web W, a stream of stock 26 is provided by head box 27 and is injected between the two wires 68.66 for simultaneous drainage through both wires. The stock 26 is then carried through the forming zone 16 where the suction means 62 and 64 drain the paper web in formation in both leftward and rightward directions as already described to greatly improve the quality and uniformity of the sheet.

Figure 4:
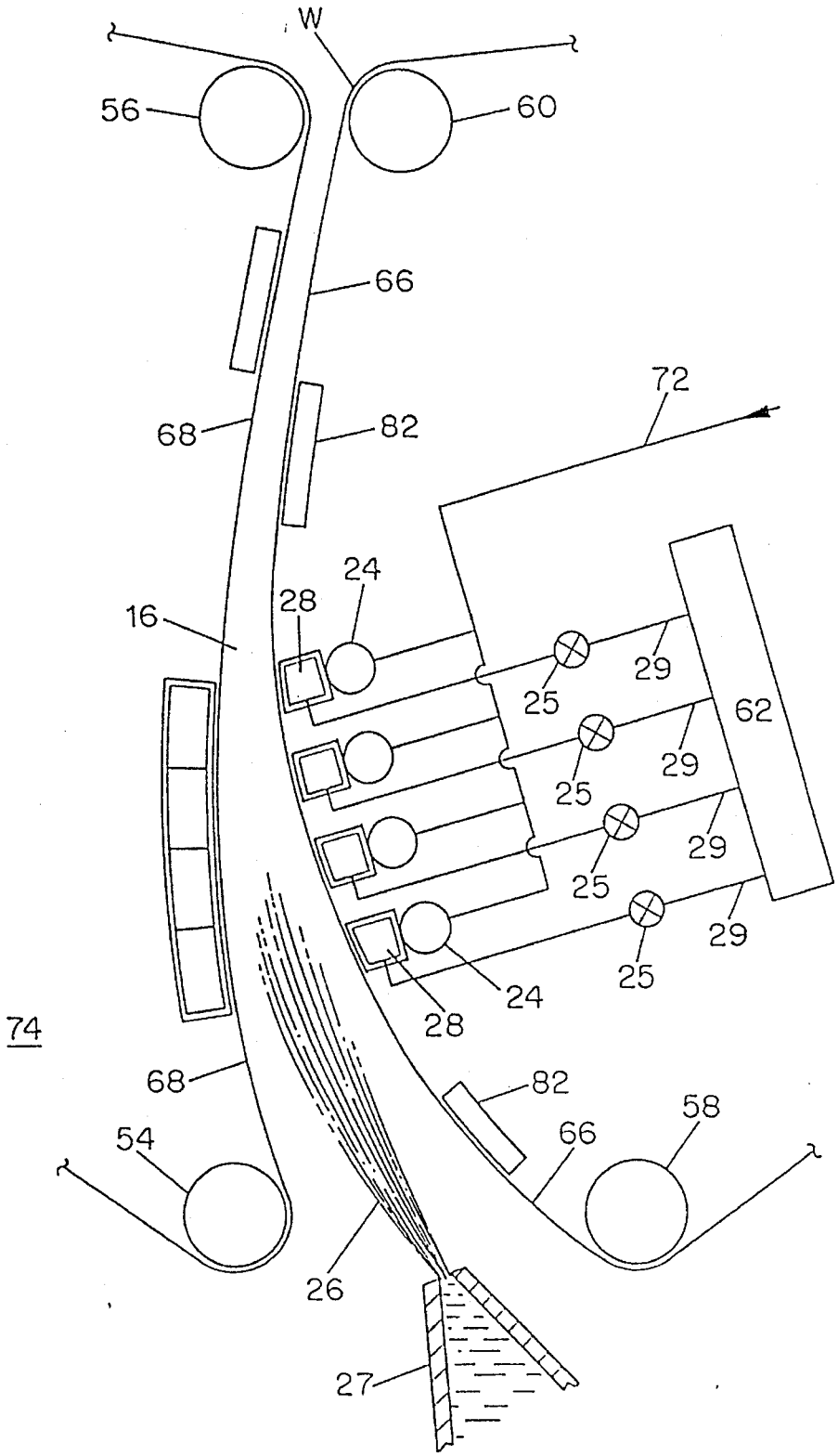
FIG. 4 is a schematic view partly in elevation and partly in cross-section of a twin-wire former having a curved vertical forming zone and incorporating means for effecting adjustment of the forming zone geometry in accordance with this invention.

Referring now to FIG. 4 of the drawing, this shows an alternate embodiment of a vertical adjustable twin-wire gap former which is namely, a curved gap former 74. This curved gap former 74 operates in much the same way as the gap former as shown in FIG. 3, except that curved shoes or boxes 82 are utilized to impart a pronounced curvature to the path of wire 66. The curvature can be either concave or convex.

The first wire or fabric 66 of curved gap former 74 coacts with a first means for applying suction 62 located adjacent the first wire 66 for draining water from the paper web W in formation in a rightward direction. The second wire or fabric 68 coacts with a second means for providing suction 64 for draining the web W in formation also in a side direction. Suction boxes 28, are adjacent to the first wire or fabric 66 and are independently moveable of one another relative to the first wire or fabric 66, whereby to alter the path of wire 66 in the forming zone 16. In order to effect move of the suction boxes 28, preferably all of them moving means 72 for adjustably positioning suction boxes 28, one for each movable suction box 28, interacts with the associated moveable suction box so as to move the first wire 66 toward and away from the second wire 68. As mentioned previously, the pressure in the forming zone 16, that is the pressure exerted on the stock 26 between the first wire 66 and the second wire 68 is determined by the path of the wires 66, 68 which in turn is determined by the positions of the moveable suction boxes 28. Therefore, the movement of the suction boxes 28 directly correlates to the pressure in the forming zone 16.

Figure 5:
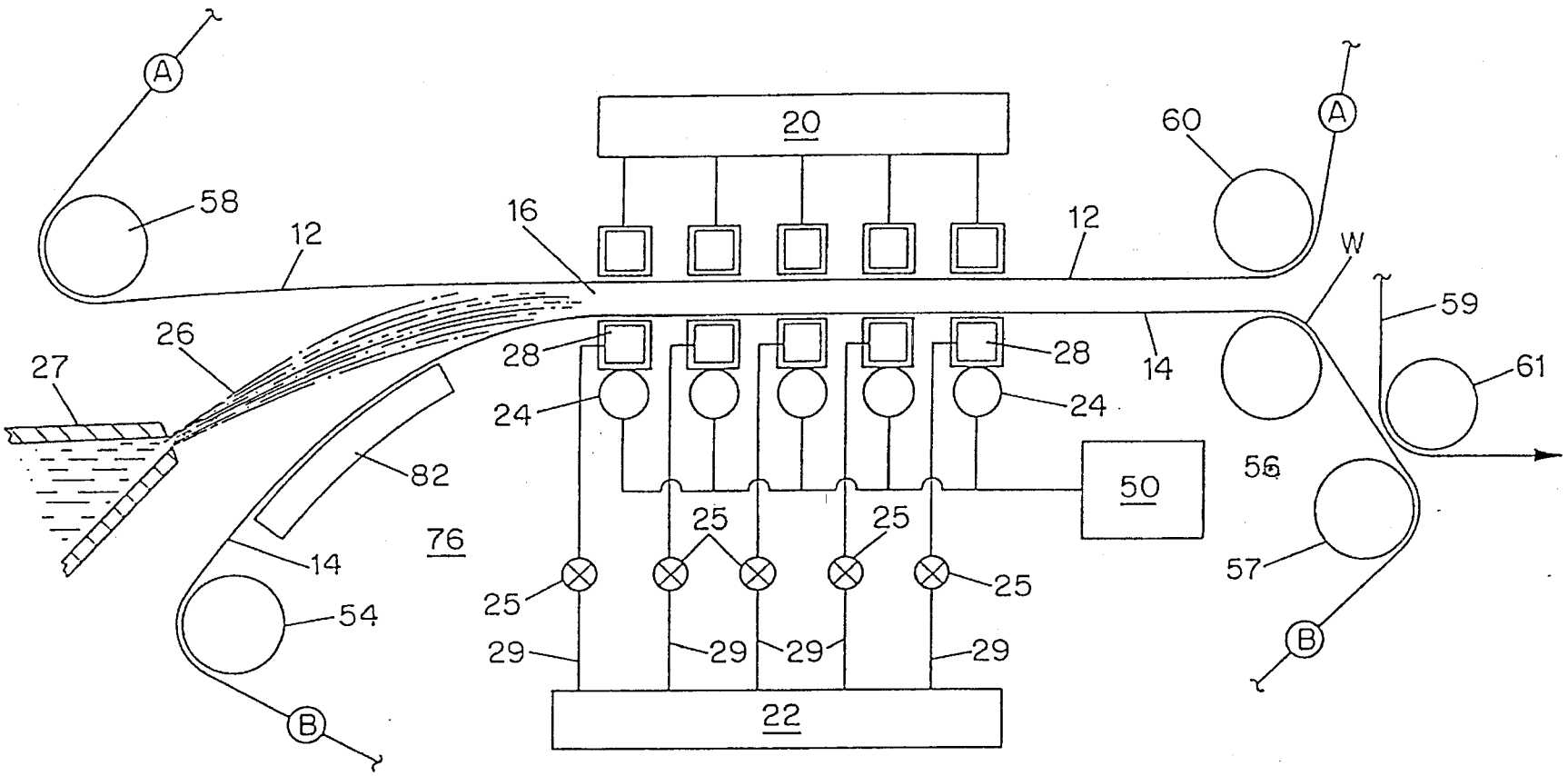
FIG. 5 is a schematic view partly in elevation and partly in cross-section of another embodiment of an adjustable twin-wire gap former.

FIG. 5 shows a curved gap former 76 embodiment, much in accordance with FIG. 1 of the invention except that curved shoes or boxes 82 are utilized in order to substantially determine the curvature of the path of wire 14 and that stock 26 is provided via head box 27 at an angle to the substantially straight horizontal forming zone 16.

Specifically, the lower wire or fabric 14 of curved gap former 76 approaches the forming zone 16 by passing around a breast roll 54 and over curved shoe or box 82 which provides pre-drainage, which is utilized in order to substantially determine the curvature of the path of the wire 14. The wire 14 then travels into the forming zone 16 where it travels in spaced apart but confronting relation with first wire 12. The first or upper wire 12 travels through a path around a breast roll 58 and then through a forming zone 16 in a substantially straight, substantially horizontal leg and then around guide roll 60 and back to roll 58 along a path determined by convenience which is not shown and which forms no part of the invention per se. After leaving the forming zone 16, the lower or second wire 14, along with web W formed between wires 12 and 14 in the forming zone, passes around a roll 56 and then downwardly at an angle toward a roll 57. Between roll 56 and 57, the web W is picked off wire 14 by a felt 59 at the suction roll 61 to transfer web W to a press section (not shown).

Similar to the embodiment as shown in FIG. 1, the first wire fabric 12 coacts with a first means for applying suction 20 located above and adjacent the first wire 12 for draining water from the paper web W in formation in an upward direction. The second wire or fabric 14 coacts with a second means for providing suction 22 for draining the web W in formation in a downward direction. Suction boxes 28, however, are adjacent and below the second wire or fabric 14 and are independently moveable of one another relative to the second wire or fabric 14, whereby to alter the path of wire 14 in the forming zone 16. Otherwise, this embodiment as shown and described in FIG. 5, operates in the same way as described above with regard to FIG. 1.

Figure 6:
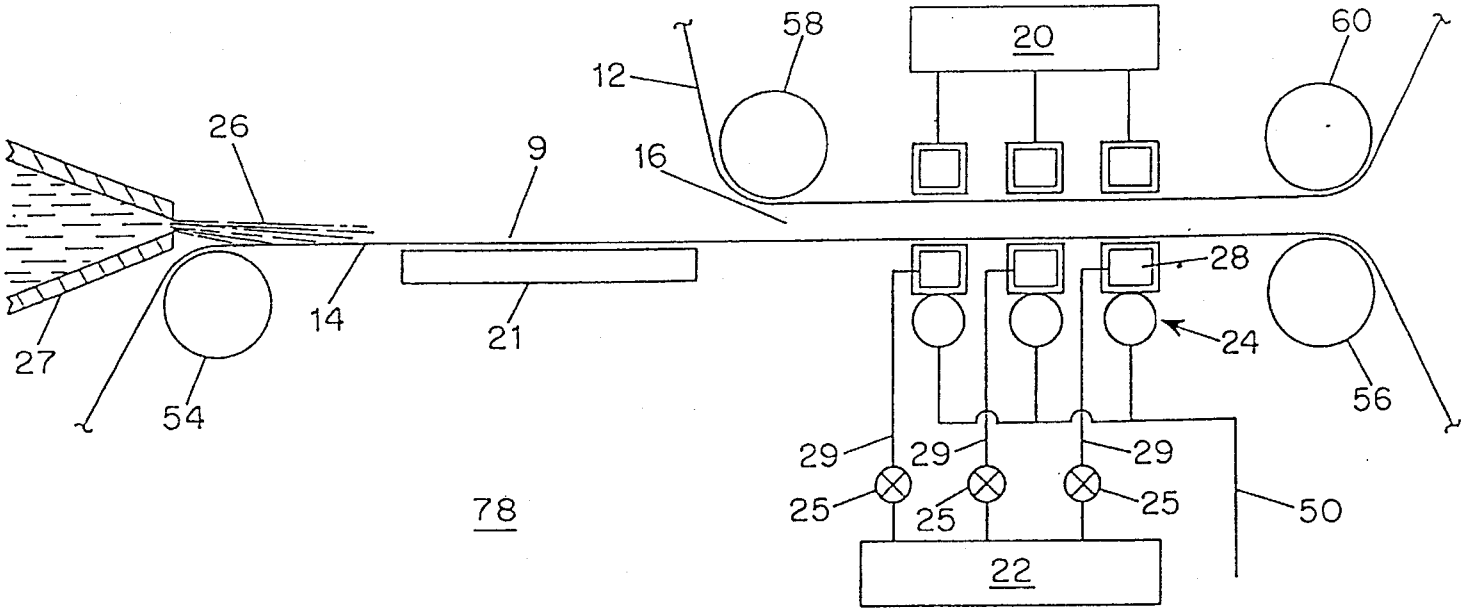
FIG. 6 is a schematic view partly in elevation and partly in cross-section of a hybrid former incorporating the adjustable twin-wire feature of the present invention.

FIG. 6 shows an alternate type of gap former, namely a hybrid twin-wire former 78, wherein the initial dewatering is in one direction only, like a fourdrinier section. Down stream a second or top wire is added for two sided dewatering. Thus, the bottom wire 14 is elongated compared to the top wire 12. The hybrid gap former 78 of FIG. 6 preferably includes a stationary straight top suction box 20 adjacent to the top wire 12. The bottom wire 14 is elongated as compared to top wire 12 but operates in the forming zone 16 in much the same fashion as described in the embodiment of FIG. 1.

In order to produce a paper web W, a stream of stock 26 is provided by head box 27 on the horizontal bottom wire 14 and is initially drained by gravity and preferably also by draining devices 21 such as, for example, suction boxes, foils, etc. After leaving the single wire portion 9 of the forming zone, the stock 26 is then carried through the twin wire portion of the forming zone 16 where it is further drained by a suction device 20 located above and adjacent the top wire 12. This suction device provides drainage to the paper web in formation in an upward direction. The bottom wire or fabric 14 also preferably has suction boxes 22 which provide drainage to the web in formation in a downward direction. The suction boxes 28 are independently movable relative to the second wire or fabric 14 as well as connectable with the suction means 22 as described above with regard to FIG. 1.

It will also be understood that the objects set forth above, are not limited to any type of forming section. Accordingly, it is intended that all matter contained in the above description shall be utilized with any type forming section including the pre-forming over a roll gap former followed by the invention.

It will thus be seen that the objects set forth above, among those made apparent from the preceding descriptions, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also should be understood that the following claims are intended to cover all of the generic and specific features of the invention herein described and all statements of the scope of the invention which, as a matter of language, might be said to fall therebetween. In this regard, the terms "forming wires" and "forming fabrics" are used generically and interchangeably and are not intended to limit the element so named to any particular material from which it is made.

It should be understood that the preferred embodiments and examples described are for illustrative purposes only and are not to be construed as limiting the scope of the present invention which is properly delineated only in the appended claims.

What is claimed is:

1. An adjustable free jet twin-wire former for forming a fiber web from an aqueous fiber suspension comprising:

a free jet head box structured and arranged to emit the aqueous fiber suspension;

first and second coacting, traveling looped forming wires having substantially parallel juxtaposed sections which between them define a free jet variable pressure twin-wire forming zone path for confining the aqueous fiber suspension emitted from said head box and for confining the paper web therebetween during its formation;

a first suction means for applying a suction located adjacent said first wire for draining water from said suspension in said forming zone through said first wire to form the fiber web;

a second suction means arranged opposite to said first suction means for applying a suction adjacent said second wire for draining water from said suspension in said forming zone through said second wire to form the fiber web, said second suction means comprising a suction box, a movable suction box cover, means for moving said suction box cover relative to said second suction box, and a means for sealing said movable suction box cover to said suction box irrespective of the position of said movable suction box cover relative to said second suction box; and said means for moving said movable suction box cover of said section suction means being structured for moving said movable suction box cover toward and away from said second wire for controlling the pressure in said forming zone and for maintaining said first and second wires substantially parallel throughout the forming zone path, said means for moving said suction box cover toward and away from said second wire being controlled independently of the first suction means for draining water from said aqueous fiber suspension and structured and arranged for controlling the pressure exerted by said first and second forming wires on the aqueous fiber suspension independently of the suction exerted by said suction box of said second suction means.

2. The adjustable free jet twin-wire former of claim 1, wherein said first suction means and said second suction means are controlled independently of each other.

3. The adjustable free jet twin-wire former of claim 1, wherein said first suction means comprises a suction box, a suction box cover, means for moving said suction box cover relative to said first suction box, and means for sealing said suction box cover to said first suction box irrespective of their relative position.

4. The adjustable free jet twin-wire former of claim 3, wherein said moveable suction box cover is slotted.

5. The adjustable free jet twin-wire former of claim 3, wherein said means for sealing of said first suction means comprises a bellows connected to said first suction box and to said suction box cover.

* * * * *